US006804366B2

(12) United States Patent
Takahashi et al.

(10) Patent No.: US 6,804,366 B2
(45) Date of Patent: Oct. 12, 2004

(54) SPEAKER APPARATUS

(75) Inventors: Osamu Takahashi, Tendo (JP); Takeshi Kaiwa, Tendo (JP); Masanori Ito, Tendo (JP)

(73) Assignees: Pioneer Corporation, Tokyo-to (JP); Tohoku Pioneer Corporation, Yamagata-ken (JP)

( * ) Notice: Subject to any disclaimer, the term of this patent is extended or adjusted under 35 U.S.C. 154(b) by 0 days.

(21) Appl. No.: 10/002,127

(22) Filed: Dec. 5, 2001

(65) Prior Publication Data

US 2002/0067842 A1 Jun. 6, 2002

(30) Foreign Application Priority Data

Dec. 5, 2000 (JP) ..... P2000-369671

(51) Int. Cl.[7] ..... H04R 25/00
(52) U.S. Cl. ..... 381/397; 381/430
(58) Field of Search ..... 381/397, 396, 381/412, 413, 419, 420, 430, 433, FOR 159, FOR 152, FOR 161

(56) References Cited

U.S. PATENT DOCUMENTS

| | | | | |
|---|---|---|---|---|
| 4,520,237 A | * | 5/1985 | Murakami | |
| 5,909,015 A | * | 6/1999 | Yamamoto et al. | 381/397 |
| 6,430,300 B1 | * | 8/2002 | Cox et al. | 381/397 |

FOREIGN PATENT DOCUMENTS

| | | | | |
|---|---|---|---|---|
| EP | WO 92/21217 | * | 11/1992 | 381/FOR 152 |
| JP | 53-129023 | * | 11/1979 | |
| JP | 57-23395 | * | 2/1982 | 381/FOR 152 |
| JP | 3-220897 | * | 9/1991 | |
| JP | 3-239099 | * | 10/1991 | 381/FOR 159 |
| JP | 6-178390 | * | 6/1994 | 381/FOR 159 |

* cited by examiner

*Primary Examiner*—Sinh Tran
(74) *Attorney, Agent, or Firm*—Nixon & Vanderhye P.C.

(57) ABSTRACT

An external magnetic-type speaker apparatus includes a magnetic circuit that is provided with a yoke having a center pole, ring-shaped magnet and plate. The magnetic circuit and the edge of a vibrating plate are attached to a support frame. Ventilation holes are formed in the side surface of the support frame for allowing air inside the apparatus to escape.

8 Claims, 4 Drawing Sheets

SPEAKER APPARATUS

BACKGROUND OF THE INVENTION

1. Field of the Invention

This invention relates to an external magnetic-type speaker apparatus, and more particularly to a small speaker apparatus for use in a mobile telephone or the like.

2. Description of the Related Art

Most small speakers used in mobile telephones are internal magnetic-type speakers that have limited dimensions.

For these internal magnetic-type speakers, it is possible to maintain enough space in the section that corresponds to the rear of the vibrating plate of the frame such that it is possible to form air-escape holes. Air is let to escape in this way so as not to hinder vibration of the vibrating plate.

Also, for the aforementioned kind of internal magnetic-type speakers, it is possible to maintain enough space in the section that corresponds to the rear of the vibrating plate such that it is possible to apply a damping material for acoustical resistance.

However, in the case of using this kind of conventional internal magnetic-type speaker, it is necessary to use a column-shaped piece, which has a smaller diameter than the inside of the voice coil of the magnetic circuit, as the magnet, so the size of the magnet is limited. As a result, improvement of the sensitivity is also limited.

In contrast to this, in the case of using an external magnetic-type speaker, it is necessary to use a magnet, which has a smaller diameter than the frame for forming the air-escape holes described above, so it is still impossible to increase the size of the magnet.

SUMMARY OF THE INVENTION

In order to solve the aforementioned problems, it is the objective of this invention to provide a small speaker apparatus that is capable of allowing air to escape, and that has better sensitivity than a conventional speaker.

The above object of the present invention can be achieved by a speaker apparatus provided with: a magnetic circuit having an external magnet; a dome-type vibrating plate; a frame that is located around the magnetic circuit and to which the magnetic circuit and edge of the vibrating plate are attached; and a ventilation section that is formed at a specified location in the side surface of the frame, which is nearly parallel with side surface of the magnet, for letting the air between the rear surface of the vibrating plate and the magnetic circuit escape.

According to the present invention, the speaker apparatus is provided with a frame to which a magnetic circuit and the edge of a dome-shaped vibrating plate are fastened, and where the side surface of this frame is nearly parallel with the side surface of the aforementioned magnet. In addition, there is a ventilation section at a specified location on the side surface of the frame for letting air between the rear surface of the vibrating plate and the magnetic circuit escape. Therefore, it is possible to prevent the pressure in the space between the rear surface of the vibrating plate and the magnetic circuit from becoming high, such that the vibrating plate vibrates smoothly and accurately according to an input signal. Moreover, even when using an external magnet, the position of the sides of the external magnet, or in other words the outer diameter of the external magnet, can be set on the inner wall of the side surface of the frame in which the aforementioned ventilation section is formed, and thus it is possible to use a large magnet of which the size of the dome-shaped vibrating plate is not limited. Also, sensitivity is greatly improved in comparison with a conventional speaker.

In one aspect of the present invention, said ventilation section is a window-shaped opening section that is formed in said frame.

According to this aspect, the aforementioned ventilation section is a window-shaped opening that is formed in the frame, so it is possible to prevent the pressure in the space between the rear surface of the vibrating plate and the magnetic circuit from becoming high such that the vibrating plate vibrates smoothly and accurately according to an input signal. Moreover, even when using an external magnet, the position of the sides of the external magnet, or in other words the outer diameter of the external magnet, can be set on the inner wall of the side surface of the frame in which the aforementioned ventilation section is formed, and thus it is possible to use a large magnet of which the size of the dome-shaped vibrating plate is not limited. Also, sensitivity is greatly improved in comparison with a conventional speaker. Furthermore, since the aforementioned opening is formed in a window shape, damping material can be installed easily.

In another aspect of the present invention, damping material is attached to opening section.

According to this aspect, the aforementioned opening is formed in the frame and has a window shape so it is possible to easily install damping material. By installing damping material to the opening, the damping material can be used for acoustical resistance, making it easy to perform acoustical control.

In further aspect of the present invention, said frame comprises: a first frame to which the edge of the vibrating plate is attached; and a second frame to which the magnetic circuit is attached, wherein the first frame is fastened to the second frame.

According to this aspect, the aforementioned frame is provided with a first and second frame, such that the edge of the vibrating plate is attached to the first frame, and the magnetic circuit is attached to the second frame. Moreover, the first frame and second frame are attached together. Therefore it is easy to construct a frame in which the aforementioned ventilation section is formed in the side surface. With the ventilation section described above, it is possible to prevent the pressure in the space between the rear surface of the vibrating plate and the magnetic circuit from becoming high, such that the vibrating plate vibrates smoothly and accurately according to an input signal. Moreover, even when using an external magnet, the position of the sides of the external magnet, or in other words the outer diameter of the external magnet, can be set on the inner wall of the side surface of the frame in which the aforementioned ventilation section is formed, and thus it is possible to use a large magnet of which the size of the dome-shaped vibrating plate is not limited. Also, sensitivity is greatly improved in comparison with a conventional speaker. Furthermore, since the aforementioned opening is formed in a window shape, damping material can be installed easily.

In further aspect of the present invention, the ventilation section is a window-shaped opening section that is formed by the first and second frames.

According to this aspect, the aforementioned ventilation section is an opening that is formed into a window shape by the first and second frames, so by forming a U-shaped opening on the side surface of the second frame, for example, and by attaching the first and second frames together such that the opened side is covered by the first frame, it is possible to easily form a window-shaped opening.

In further aspect of the present invention, damping material is attached to the opening section.

According to this aspect, the aforementioned opening is formed into a window shape by the first and second frames, so it is possible to easily attach damping material. Also, by attaching damping material to the opening, the damping material functions as acoustical resistance, making it possible to easily perform acoustical control.

In further aspect of the present invention, a cylindrical-shaped hollow section is formed in the center of the yoke of the magnetic circuit, and damping material is attached to the bottom of the hollow section.

According to this aspect, the yoke of the aforementioned magnetic circuit is formed with a cylindrical-shaped hollow section in the center, and the damping material is attached to the bottom of the hollow section. Air is taken into and discharged from the internal space that is formed by the rear surface of the vibrating plate and magnetic circuit, making it possible to reduce the pressure in this internal space.

DESCRIPTION OF THE PREFERRED EMBODIMENTS

The preferred embodiments of the present invention will be explained with reference to the drawings.

First Embodiment

First, a first embodiment of the invention will be explained with reference to FIG. 1A, FIG. 1B and FIG. 2.

Figure 1A:
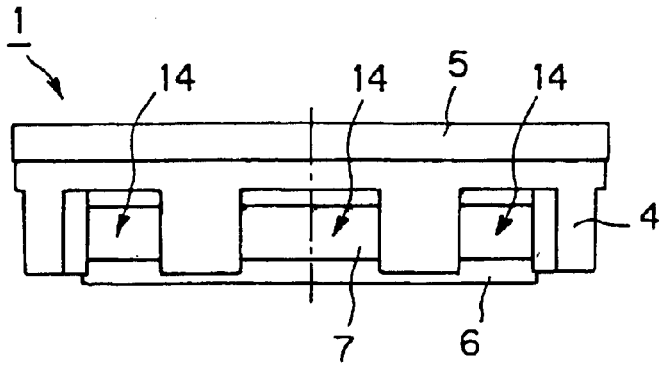
FIG. 1A is a drawing of the side surface of the speaker apparatus of a first embodiment of the invention.
Figure 1B:
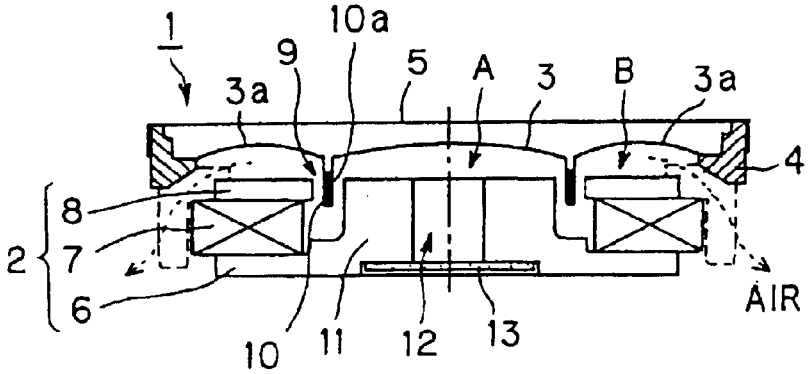
FIG. 1B is a cross-sectional drawing of the speaker apparatus of the first embodiment of the invention.

FIG. 1A is a drawing of the side surface of the speaker apparatus of the first embodiment of the invention, and FIG. 1B is a cross-sectional drawing of the speaker apparatus of this first embodiment of the invention. The speaker apparatus 1 shown in FIG. 1A, FIG. 1B is provided with a magnetic circuit 2, a vibrating plate 3, a support frame 4 for supporting the vibrating plate 3 with respect to the magnetic circuit 2, and a cover 5.

The magnetic circuit 2 is constructed as an external magnetic-type magnetic circuit, and is provided with: a yoke 6 having a center pole 11 formed in its center, a ring-shaped magnet 7 that is placed around the center pole 11 of the yoke 6, and a ring-shaped plate 8 that is attached to the top of the magnet 7.

Moreover, the aforementioned magnetic circuit 2 is constructed from the magnet 7, the center pole 11 of the yoke 6, and the plate 8, such that the magnetic flux of the magnet 7 is concentrated in the magnetic gap 9 that is located in the space between the surface on the inside of the plate 8 and the outer surface on the end of the center pole 11.

Next, the vibrating plate 3 is formed as a hemispherical dome-shaped diaphragm, and a cylindrical-shaped voice coil 10*a* that is wrapped with a voice coil 10 is attached to the base of the vibrating plate 3. The voice coil 10 is located on the inside of the magnetic gap 9 of the magnetic circuit 2. This voice coil 10 connects to an external connection terminal via a wire or the like (not shown in the figure).

Also, the aforementioned support frame 4 supports the edge 3*a* of the vibrating plate 3. This speaker apparatus 1, constructed as described above, generates a driving force in the voice coil 10, which is located in the magnetic gap 9, according to a signal current that is applied to the voice coil 10, and vibrates the vibrating plate 3 to generate sound.

The center pole 11 is shaped as shown in FIG. 1B with a ventilation hole 12 through the center. This ventilation hole 12 is for taking air into or discharging air from the internal space "A" inside the speaker apparatus 1 that is formed by the vibrating plate 3 and the magnetic circuit 2. In other words, by discharging air from the aforementioned internal space "A" to the outside of the speaker apparatus, or by taking air into the internal space "A" from the outside of the apparatus, this ventilation hole 12 is able to reduce the pressure inside the internal space "A" of the speaker apparatus 1.

Moreover, damping material 13 is applied to the bottom of the center pole 11 as shown in FIG. 1B. This damping material 13 functions as acoustical resistance, making it easy to perform acoustical control.

Figure 2:
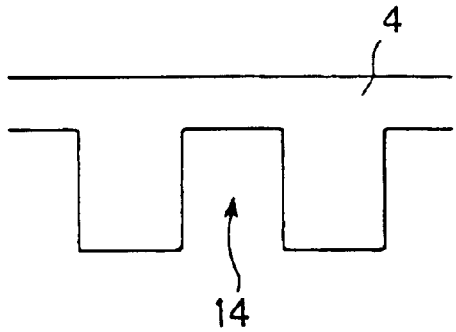
FIG. 2 is an enlarged partial view of the support frame of the speaker apparatus in FIG. 1.

The support frame 4 for the speaker apparatus 1 described above is made of plastic, and is shaped with openings as shown in FIG. 1A and FIG. 2. These openings are U-shaped openings that are cut out from the bottom of the speaker apparatus 1, and function as ventilation sections 14. These ventilation sections 14 are capable of preventing the pressure in the space at the rear of the vibrating plate 3 and edge 3*a* from becoming high, since the air in this rear space, or in other words, the air in the space between the vibrating plate 3 and edge 3*a* and the magnetic circuit 2 escapes to the outside by way of the ventilation sections 14 when the vibrating plate 3 and edge 3*a* vibrate. Therefore, it is possible for the vibrating plate 3 to vibrate smoothly and accurately according to an input signal.

Furthermore, in this embodiment of the invention, by forming the ventilation sections 14 on the side surface of the support frame 4, it is possible to increase the outer diameter of the magnet 2 until it comes in contact with the inner wall on the side of the support frame 4. Therefore, even in the case of an external magnetic-type speaker apparatus, it is possible to let the air escape as described above, as well as increase the cross-sectional area of the magnet 2, and thus it is possible to improve the sensitivity of the speaker apparatus when compared with a conventional speaker apparatus.

Figure 7A:
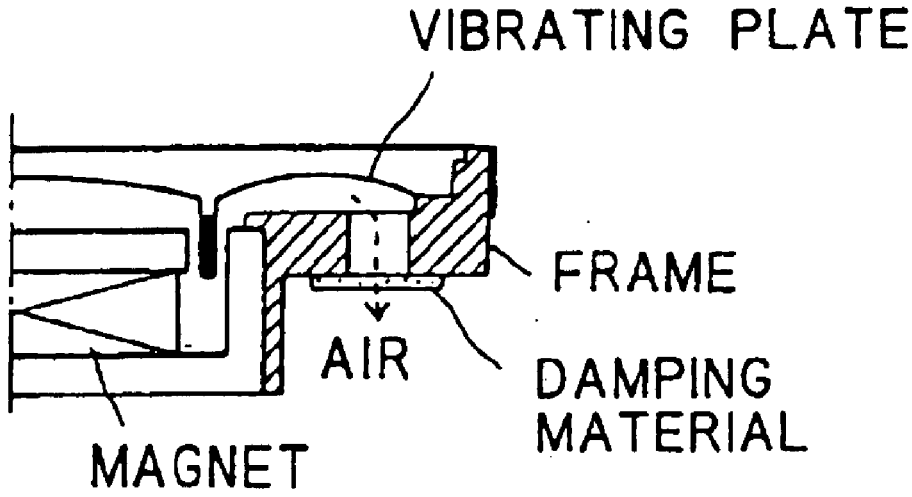
FIG. 7A (PRIOR ART)
FIG. 7A is a cross-sectional drawing of a conventional internal magnetic-type speaker apparatus that is compared with the present invention.
Figure 7B:
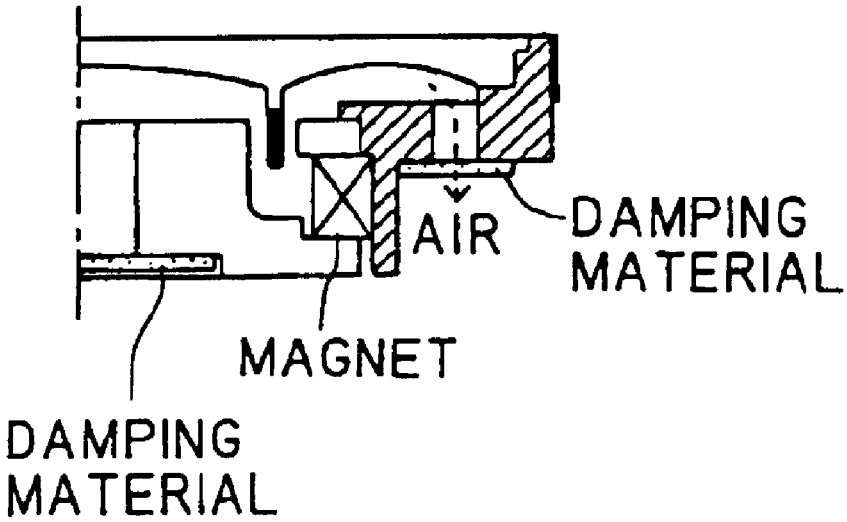
FIG. 7B (PRIOR ART)
FIG. 7B is a cross-sectional drawing of a conventional external magnetic-type speaker apparatus that is compared with the present invention.

The outstanding effect of the speaker apparatus of this embodiment is made clear by comparing it with the conventional internal magnetic-type speaker apparatus shown in FIG. 7A or the conventional external magnetic-type speaker apparatus shown in FIG. 7B. In other words, as shown in FIG. 7A, in the case of a conventional internal magnetic-type speaker apparatus, the magnet must be located in the rear space of the vibrating plate, so when the size of the vibrating plate is limited, the size of the magnet is also limited, and it is not possible to use a large magnet. Therefore, it is difficult to improve sensitivity.

Moreover, as shown in FIG. 7B, in the case of a conventional external magnetic-type speaker apparatus, the ventilation hole for letting air escape is located on the bottom frame, so the inner wall of the frame is located further on the inside than the ventilation hole by just the amount of the frame thickness. As a result, as shown in FIG. 7B, the external dimensions of the magnet cannot be made large.

In contrast to this, as shown in FIGS. 1A and 1B, in the case of the speaker apparatus of this embodiment, the ventilation holes 14 are formed on the side surface of the support frame 4, making it possible for the position of the inner wall of the support frame 4 to be located at the same position as the ventilation holes 14, so it is possible to increase the outer diameter of the magnet 2. Therefore, it is possible to improve the sensitivity in comparison to the conventional speaker apparatus.

Second Embodiment

Next, a second embodiment of the invention will be explained in reference to FIG. 3A, FIG. 3B and FIG. 4. The same code numbers will be used for sections that are the same as in the first embodiment, and any redundant explanation will be omitted.

Figure 3A:
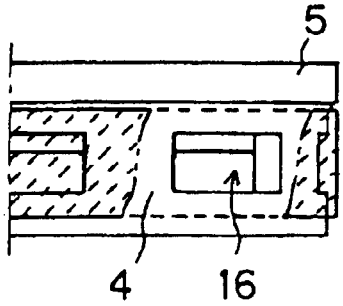
FIG. 3A is a drawing of the side surface of the speaker apparatus of a second embodiment of the invention.
Figure 4:
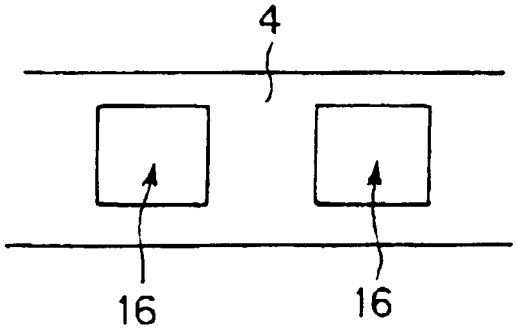
FIG. 4 is an enlarged partial view of the support frame of the speaker apparatus in FIG. 3.

In this embodiment of the invention, the shape of the ventilation holes in the support frame 4 is as shown in FIG. 3A and FIG. 4. In other words, square window-shaped ventilation holes 16 are formed on the side of the support frame 4.

Figure 3B:
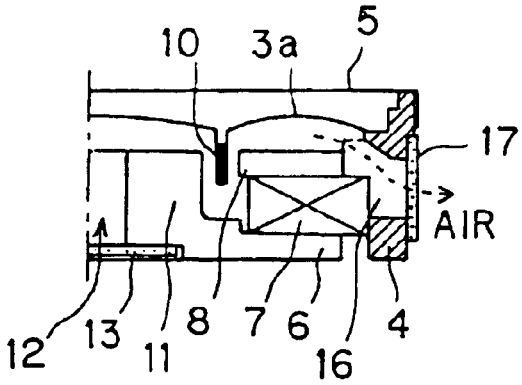
FIG. 3B is a cross-sectional drawing of the speaker apparatus of the second embodiment of the invention.

As shown in FIG. 3B, by using this kind of construction, not only is it possible to let the air escape and to use a large magnet 7, but as shown in FIGS. 3A and 3B, it is also possible to attach damping material 17 on the side of the support frame 4 such that it covers the ventilation holes 16. This damping material 17, which functions as acoustical resistance, can also be used on the ventilation holes 16 that are formed on the side surface of the support frame 4, thus simplifying acoustical control. In other words, the velocity of air particles inside the apparatus is slower than when there is no damping material 17, and thus it is possible to change the resonance point of the overall speaker apparatus and lengthen the length of the acoustical section more than the visible length, and as a result, it is possible to provide a speaker apparatus with a lowered resonance frequency and a widened reproduction bandwidth in the low-pitched tone range. Moreover, by attaching the damping material 17, it is possible to suppress the amplitude of vibration of the vibrating plate 3, as well as suppress the sound pressure characteristic at the resonance frequency. As a result, it is possible to make the frequency characteristic a flat characteristic.

Also, by selecting the size or quality of the damping material, it is possible to easily perform acoustical control.

Third Embodiment

Next, a third embodiment of the invention will be explained with reference to FIG. 5A, FIG. 5B and FIG. 6. The same code numbers will be used for sections that are the same as in the first embodiment, and any redundant explanation will be omitted.

Figure 5A:
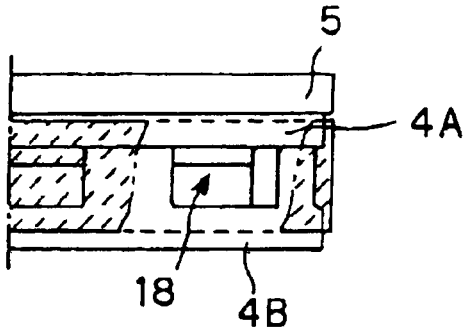
FIG. 5A is a drawing of the side surface of the speaker apparatus of a third embodiment of the invention.
Figure 5B:
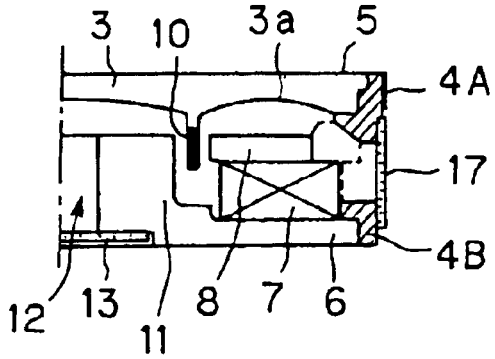
FIG. 5B is a cross-sectional drawing of the speaker apparatus of the second embodiment of the invention.
Figure 6:
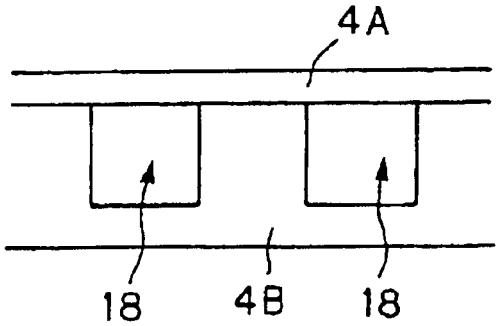
FIG. 6 is an enlarged partial view of the support frame of the speaker apparatus in FIG. 5.

As shown in FIG. 5A, FIG. 5B and FIG. 6, in this embodiment, the support frame is constructed in two pieces, a first frame 4A and a second frame 4B. As a result in this case as well, it is possible to apply damping material 17 to the side surface of the support frame.

By constructing the support frame in two pieces in this way, it is possible to form window-shaped ventilation holes 18 by attaching the first frame 4A to the second frame 4B, and construction of the parts is simplified when compared to the case of forming ventilation holes in the side surface of the support frame as in the second embodiment.

In this case as wekk, by applying damping material 17, the damping material can be made to function as acoustical resistance, and the velocity of air particles in this section is slower than when there is no damping material 17, and thus it is possible to change the resonance point of the overall speaker apparatus and lengthen the length of the acoustical section more than the visible length, and as a result, it is possible to privide a speaker apparatus with a lowered resonance frequency and a widened reproduction bandwidth in the low-pitched tone range. Moreover, by attaching the damping material 17, it is possible to suppress the amplitude of vibration of the vibrating plate 3, as well as suppress the sound pressure characteristic at the resonance frequency. As a result, it is possible to make the frequency characteristic a flat characteristic.

Also, by selecting the size or quality of the damping material, it is possible to easily perform acoustical control.

As explained above, with the speaker apparatus of this invention, air inside the apparatus escapes through the ventilation holes, thus making it possible for an external magnetic-type speaker apparatus that uses a large magnet. Therefore, it is possible to greatly improve the sensitivity compared with a conventional speaker apparatus. As a result, it is possible to provide a small speaker apparatus with good sensitivity to be used in small electronic devices such as a mobile telephone.

The shape of the ventilation holes that are formed in the side surface of the support frame is not limited to the shapes described above, and can be changed as appropriate. Also, the positions where the ventilation holes are formed can be changed as appropriate as long as they are formed in the side surface of the support frame.

The invention may be embodied in other specific forms without departing from the spirit or essential characteristics thereof. The present embodiments are therefore to be considered in all respects as illustrative and not restrictive, the scope of the invention being indicated by the appended claims rather than by the forgoing description and all changes which come within the meaning and range of equivalency of the claims are therefore intended to be embraces therein.

The entire disclosure of Japanese Patent Application No. 2000-369671 filed on Dec. 5, 2000 including the specification, claims, drawings and summary is incorporated herein by reference in its entirety.

What it claimed is:

1. A speaker apparatus comprising:

a magnetic circuit having an external magnet;

a dome-type vibrating plate having a central axis;

a support frame that is located around said magnetic circuit and to which said magnetic circuit and an edge of said vibrating plate are attached, wherein a first internal space is defined between a center of said vibrating plate and said magnetic circuit, and wherein a second internal space is defined between said edge and said magnetic circuit, the first internal space communicating with the second internal space via a magnetic gap; and a ventilation section formed in said support frame enabling air between said vibrating plate and said magnetic circuit in said first and second internal spaces to escape in a direction substantially perpendicular to said central axis of said vibrating plate, said ventilation section comprising openings cut out from a side surface of said support frame.

2. The speaker apparatus of claim 1, wherein support each opening cut out is a window-shaped opening section that is formed in said support frame.

3. The speaker apparatus of claim 2, wherein damping material is attached to said opening section.

4. The speaker apparatus of claim 1, wherein said support frame comprises:

a first frame to which the edge of said vibrating plate is attached; and a second frame to which said magnetic circuit is attached, wherein said first frame is fastened to said second frame.

5. The speaker apparatus of claim 1 wherein a cylindrical-shaped hollow section is formed in the center of the yoke of said magnetic circuit, and damping material is attached to the bottom of said hollow section.

6. A speaker apparatus comprising:

a magnetic circuit having an external magnet;

a dome-type vibrating plate having a central axis;

a frame that is located around said magnetic circuit and to which magnetic circuit and an edge of said vibrating plate are attached, wherein said frame comprises a first frame to which the edge of said vibrating plate is attached and a second frame to which said magnetic circuit is attached, wherein said first frame is fastened to said second frame; and a ventilation section enabling air between said vibrating plate and laid magnetic circuit to escape in a direction substantially perpendicular to said central axis of said vibrating plate, wherein said ventilation section comprises openings cut out from a bottom of the speaker apparatus and is a window-shaped opening section that is formed by said first and second frames.

7. The speaker apparatus of claim 6, wherein damping material is attached to said opening section.

8. A speaker apparatus comprising:

a magnetic circuit having an external magnet;

a dome-type vibrating plate having a central axis;

a support frame that is located around said magnetic circuit and to which said magnetic circuit and an edge of said vibrating plate are attached, wherein a first internal space is defined between a center of said vibrating plate and said magnetic circuit and wherein a second internal space is defined between said edge and said magnetic circuit, the first internal space communicating with the second internal space via a magnetic gap; and a ventilation section formed in said support frame enabling air between said vibrating plate and said magnetic circuit in said first and second internal spaces to escape in a radial direction relative to the central axis of the vibrating plate, said ventilation section comprising openings cut out from a side surface of said support frame.

* * * * *